US006202712B1

(12) United States Patent
Aguilar

(10) Patent No.: US 6,202,712 B1
(45) Date of Patent: Mar. 20, 2001

(54) SYSTEM AND METHODS FOR DELIVERING FUEL AND FOR ALIGNING ELEMENTS OF A FUEL DELIVERY SYSTEM

(76) Inventor: Freddie S. Aguilar, 7914 W. Cavalier, Glendale, AZ (US) 85303

( * ) Notice: Subject to any disclaimer, the term of this patent is extended or adjusted under 35 U.S.C. 154(b) by 0 days.

(21) Appl. No.: 09/248,545

(22) Filed: Feb. 11, 1999

(51) Int. Cl.[7] ..... B67D 5/00

(52) U.S. Cl. ..... 141/98; 141/94; 141/231; 137/234.6

(58) Field of Search ..... 141/1, 94, 98, 141/231, 232; 137/234.6

(56) References Cited

U.S. PATENT DOCUMENTS 3,095,020 * 6/1963 Darwin ..... 141/232
3,536,109 * 10/1970 Ginsburgh et al. ..... 141/98
4,681,144 * 7/1987 Horvath et al. ..... 141/1
4,881,581 * 11/1989 Hollerback ..... 141/1
5,383,500 * 1/1995 Dwars et al. ..... 141/98
6,024,137 * 2/2000 Strnad et al. ..... 141/1

* cited by examiner

*Primary Examiner*—J. Casimer Jacyna
(74) *Attorney, Agent, or Firm*—Parsons & Goltry; Robert A. Parsons; Michael W. Goltry

(57) ABSTRACT

A system for delivering fuel comprising a receiver coupled in liquid communication with a fuel tank of a vehicle, a nozzle coupled in liquid communication with a fuel source and interactive alignment structure for mating the nozzle with receiver in response to movement of the receiver and the nozzle.

9 Claims, 6 Drawing Sheets

SYSTEM AND METHODS FOR DELIVERING FUEL AND FOR ALIGNING ELEMENTS OF A FUEL DELIVERY SYSTEM

FIELD OF THE INVENTION

This invention relates to fuel delivery systems and, more particularly, to apparatus and methods for delivering fuel and for aligning a nozzle with a receiver.

BACKGROUND OF THE INVENTION

Some gas stations provide customers with full-service and self-service. The price per gallon of gasoline for full-service is higher than self-service to absorb labor costs associated with full service. To save money, most people self-service their vehicles. This requires the customer to exit her vehicle to manually pump, and pay for, the gas. Contemporary gas stations include machines that allow customers to pay for their gas at the pump with credit or debit cards. However, to enhance customer ease and efficiency of pumping gas at the self-service stations, it would be beneficial to provide a system that would allow customers to pump and pay for gas without having to leave the comfort of their vehicles.

Accordingly, it would be highly desirable to provide improved apparatus and methods for delivering fuel to a vehicle.

It is a provision of the invention to allow customers to pump and pay for gas at a filling station without having to leave the comfort of their vehicles.

It is another purpose of the present invention to provide new and improved apparatus and methods for delivering fuel to a vehicle that may be easily and inexpensively implemented with existing filling stations.

SUMMARY OF THE INVENTION

The foregoing purposes and others are realized in new and improved apparatus and methods for delivering fuel to a vehicle. An exemplary embodiment of the present invention is a fuel delivery system that includes a receiver coupled in liquid communication with a fuel tank of a vehicle. The receiver defines X, Y and Z axes. Also included is a nozzle coupled in liquid communication with a fuel source. Like the receiver, the nozzle defines X', Y' and Z' axes. Interactive alignment structure guides alignment of the Z and Z' axes and the mating of the nozzle with the receiver for fuel delivery in response to movement of the receiver along the X axis and the nozzle along the Y' and Z' axes. The interactive alignment structure is normally carried by the receiver and the nozzle and comprises an emitter carried by one of the receiver and the nozzle for emitting a stimulus, and sensor apparatus carried adjacent the other one of the receiver and the nozzle. The sensor apparatus receives the stimulus for guiding and indicating alignment of the Y and Y' axes and the Z and Z' axes in a two-dimensional plane in response to movement of the receiver along the X axis, and for guiding and indicating alignment of the Z and Z' axes. The invention includes drive apparatus for moving the nozzle along the Y' and Z' axes. When the Z and Z' axes are aligned, the drive apparatus can move the nozzle into the receiver for fuel delivery. The stimulus preferably comprises focused light or laser light, and the sensor apparatus preferably comprises a plurality of light sensors.

BRIEF DESCRIPTION OF THE DRAWINGS

The foregoing and further and more specific objects and advantages of the instant invention will become readily apparent to those skilled in the art from the following detailed description thereof taken in conjunction with the drawings in which.

DETAILED DESCRIPTION OF A PREFERRED EMBODIMENT

The present invention provides, among other things, a new and improved system and method for delivering gasoline or other liquid fuel to a vehicle and to a method of aligning a nozzle with a receiver of a fuel delivery system. Ensuing embodiments of the invention are easy to construct, easy to implement with existing fuel delivery apparatus and prove exemplary for enhancing customer ease and efficiency of pumping and paying for fuel.

Figure 1:
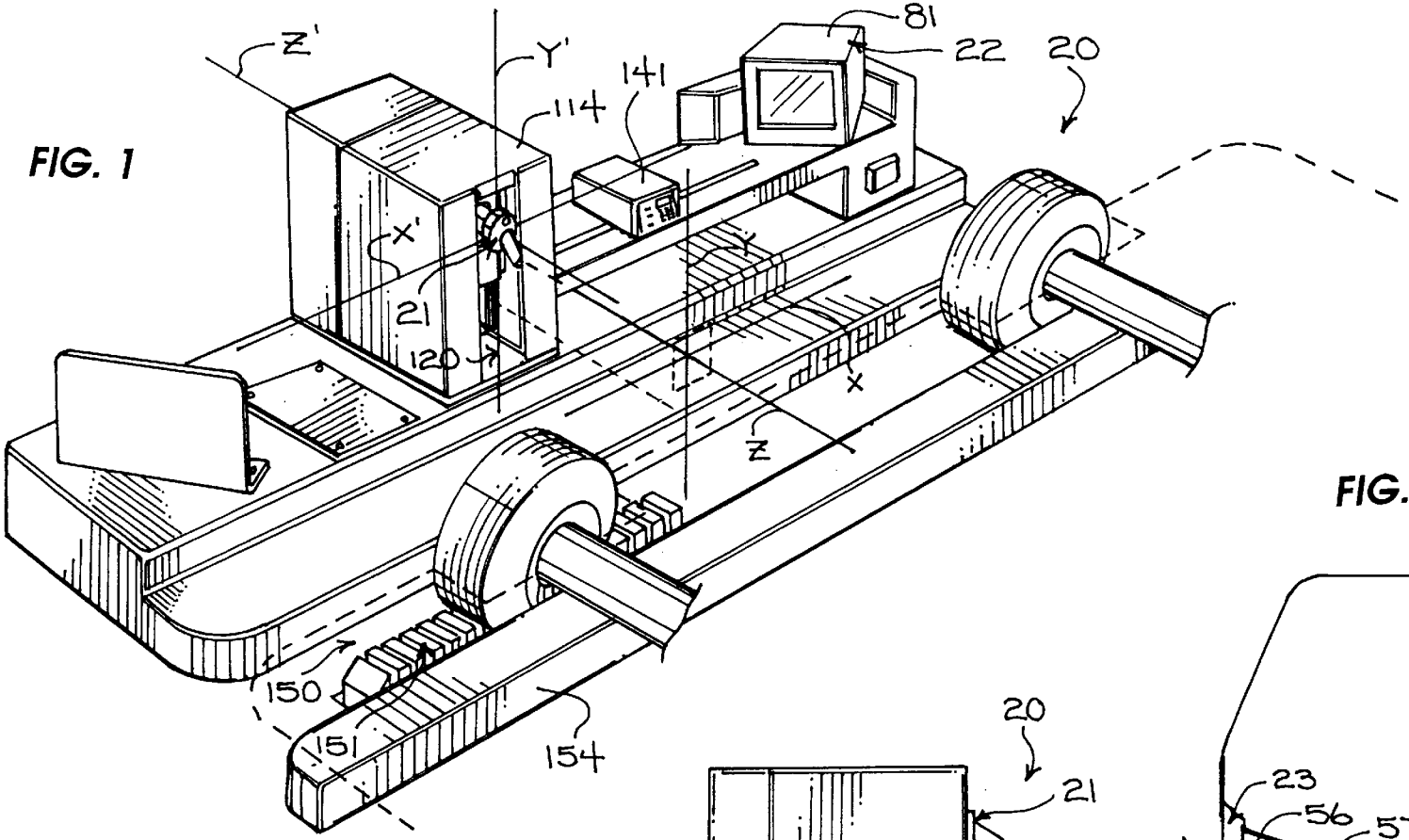
FIG. 1 is an isometric view of a system for delivering fuel to a vehicle, the system including a nozzle partially contained by a housing and a brake assembly engagable with one of the wheels of the vehicle for holding it stationary during a fueling process.
Figure 2:
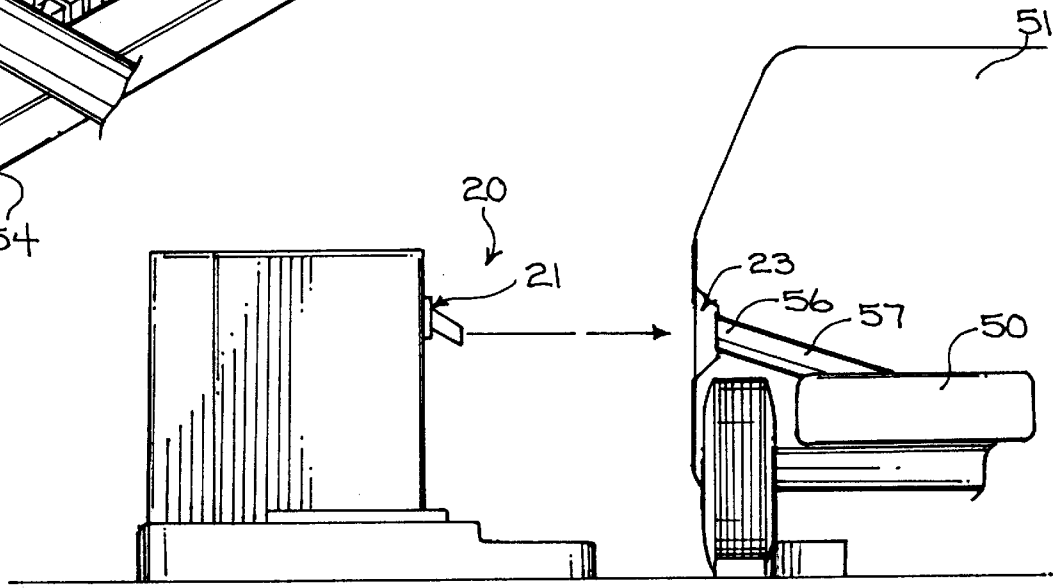
FIG. 2 is a side elevational view of the system of FIG. 1, the system further including a receiver for receiving the nozzle for facilitating fuel delivery to the fuel tank of the vehicle.

Turning now to the drawings in which like reference characters indicate corresponding elements throughout the several views, attention is first directed to FIG. 1 which illustrates an isometric view of a system 20 for delivering fuel to a vehicle. System 20 includes a nozzle 21 coupled with at least one fuel source, a computer system 22 and, as shown in FIG. 2, a receiver 23. Receiver 23 is engagable in liquid communication with a fuel tank of a vehicle and receives nozzle 21 for facilitating fuel delivery to the fuel tank.

Figure 10:
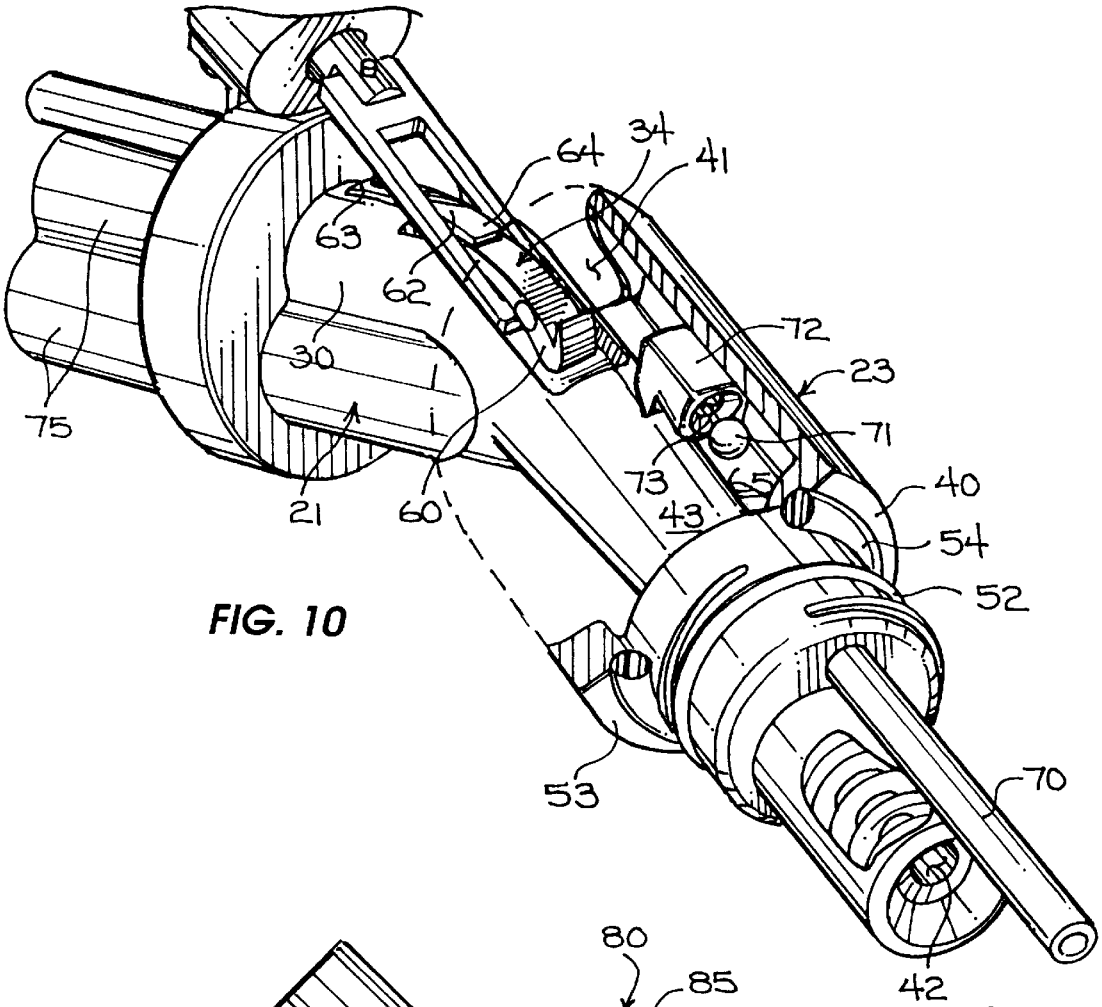
FIG. 10 is an enlarged isometric view of the nozzle of FIG. 1 with portions broken away for the purpose of illustration.
Figure 11:
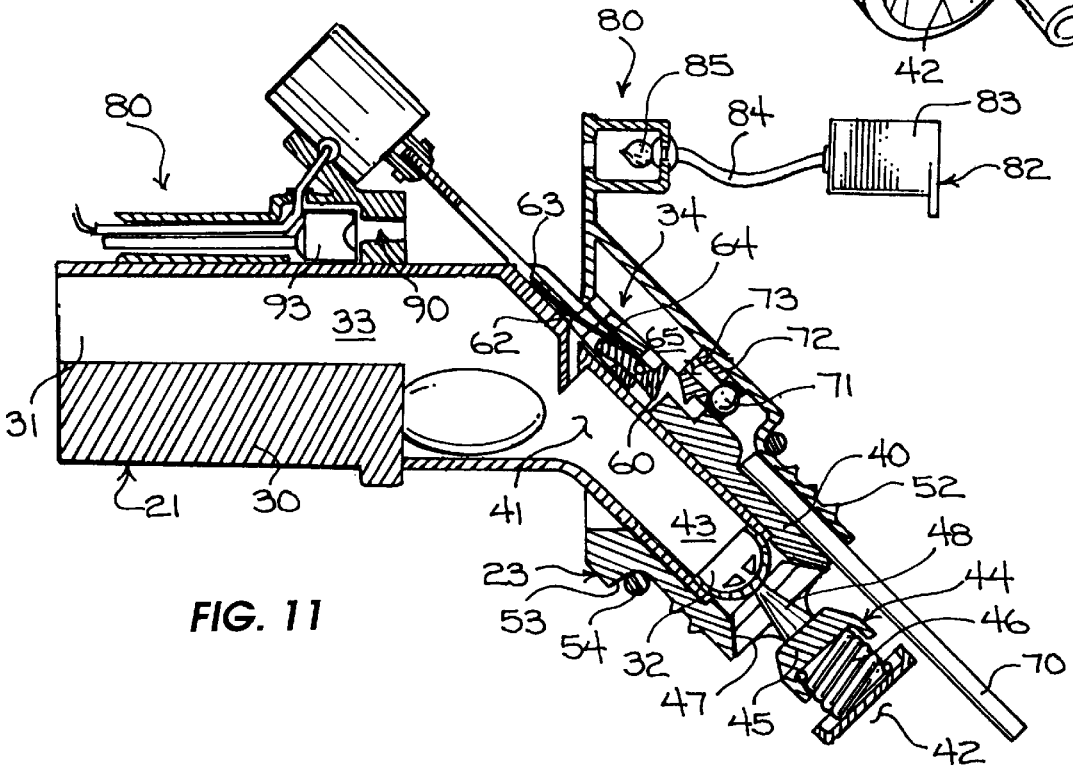
FIG. 11 is a longitudinal sectional view of the nozzle of FIG. 10.

Turning to FIG. 10, nozzle 21 includes a nozzle body 30 having, as shown in FIG. 11, an open proximal end 31 for receiving fuel, an open distal end 32 for emitting fuel and a channel 33 interconnecting the open proximal and distal ends 30 and 31 in liquid communication. In this embodiment, a switch 34 is provided for turning a valve (not shown) ON and OFF for regulating or checking the fuel flow through nozzle body 30. Receiver 23 includes a receiver body 40 having an open outer end 41, an open inner end 42 and a channel 43 therebetween. A closure 44 is located adjacent open inner end 42 for normally obstructing channel 43. In this embodiment, closure 44 includes a plug 45 and a biasing element 46. Biasing element 46, shown here as a compression spring, is captured against portions of receiver body 43 adjacent open inner end 42 and against plug 45 for normally seating plug 45 in substantially sealing engagement against a seat 47 formed in receiver body 40. An extension 48 extends outwardly from plug 45 into channel 43. Although biasing element 46 is shown as a compression spring, other means for normally biasing plug 45 against seat 47 will readily occur to the skilled artisan.

Regarding FIG. 2, receiver 23 is designed for coupling with a fuel tank or receptacle 50 of a vehicle 51 in fuel or liquid communication. Most vehicles such as cars, motor homes, trucks and vans, include an opening leading to the fuel tank. This opening normally forms part of a conduit or way that leads to the fuel tank. FIG. 2 illustrates just such an opening or open end 56 and conduit 57. Receiver 23 preferably engages the conduit at or adjacent the opening in lieu of the fuel cap that would normally be used for enclosing the open end. In this regard, open inner end 42 is placed into and through the open end 56 of conduit 57 leading to fuel tank 50. To secure receiver 23 in place with or adjacent open end 56, external threads 52 carried by receiver body 40 intermediate open outer end 41 and open inner end 42 allow threaded engagement with the inner surface of conduit 57 by rotation of receiver body 40. An annular gasket 53 encircles receiver body 40 between external threads 52 and an external endwall 53 of receiver body 40. With receiver 23 properly installed with the conduit 57 adjacent open end 56, annular gasket 54 seats and seals against structure of the vehicle bounding the open end 56. Because plug 45 normally obstructs channel 43, receiver 23 serves as a closure for open end 56.

Receiver 23 receives open distal end 32 of nozzle 21 as shown in FIG. 11 for facilitating fuel delivery to fuel tank 50. Open distal end 32 may be inserted into and through open outer end 41 and into channel 43 to engage extension 48. Through the application of sufficient force to overcome the bias of biasing element 46, plug 45 is movable from its closed position away from seat 47 to its open position allow fuel to admit through channel 43 and outwardly through open inner end 42 for receipt by the fuel tank. After fueling is complete and nozzle 21 removed from receiver 23, plug 45 returns to its normal closed position against seat 47 obstructing fuel flow through nozzle 21. However, to provide fuel flow, nozzle 21 must be actuated.

Nozzle 21 may be actuated with a conventional manual valve assembly (not shown), or with a conventional and well-known automatic valve (not shown). This automatic valve may be actuated with switch 34. Referring to FIG. 11, switch 34 includes a key 60 mounted at its midpoint for pivotal movement. Key 60 extends outwardly from nozzle body 30 intermediate open proximal end 31 and open distal end 32 and is normally biased outwardly with a biasing element 62 having an end 63 fastened to nozzle body 30 and a free end 64 positioned against key 60. In this specific example, biasing element 62 comprises an elongate metallic spring having shape memory, although skilled artisans will readily appreciate that other biasing means may be used. Receiver body 40 includes an abutment 61 that key 60 engages when nozzle body 30 is inserted into passageway 43 in a direction from open outer end 41. When key 60 engages abutment 61, it moves out of its normal outwardly biased position, past which key 60 snaps back to its normal outwardly biased position into a corridor 65 bound and defined by nozzle body 30. Key 60 is coupled to a sensor (not shown) that actuates the automatic valve (not shown) into an ON position when key 60 snaps to its normal outwardly biased position in corridor 65, which starts fuel flow through nozzle 21. When key 60 is moved inwardly from its normal outwardly biased position during fuel flow, the sensor actuates the automatic valve into an OFF position stopping the fuel flow through nozzle 21.

To accomplish this in a particular embodiment, receiver 23 supports a line or conduit 70 that extends outwardly from corridor 65 into the conduit leading to the fuel tank. When fuel is pumped into the fuel tank, displaced fumes force into corridor 65 through conduit 70 and into the fuel stream flow in channel 43. In accordance with federal regulatory law, this is common practice among conventional fuel nozzles. When the gas tank is full, liquid fuel conducts into corridor 65 through conduit 70 and flows against a hammer 71 carried freely in corridor 65 in opposition to a stopper 72 also carried in corridor 65 for reciprocal movement in relation to key 60. When the fuel flows against hammer 71, it moves against stopper 72 with sufficient force to cause stopper 72 to move against key 60 causing key 60 to move inwardly from its normal outwardly biased position. When key 60 moves inwardly from its normal outwardly biased position, the sensor coupled with key 60 actuates the automatic valve to the OFF position to stop the fluid flow through nozzle 21. When nozzle 21 is removed from receiver 23 upon completion of this fueling process, plug 45, of course, seals against seat 47 to enclose channel 43. A bore 73 extends through stopper 72 through which the gas fumes pass. However, when fuel drives hammer 71 against stopper 72, it plugs this bore 73 and drives stopper 72 against key 60.

Figure 6:
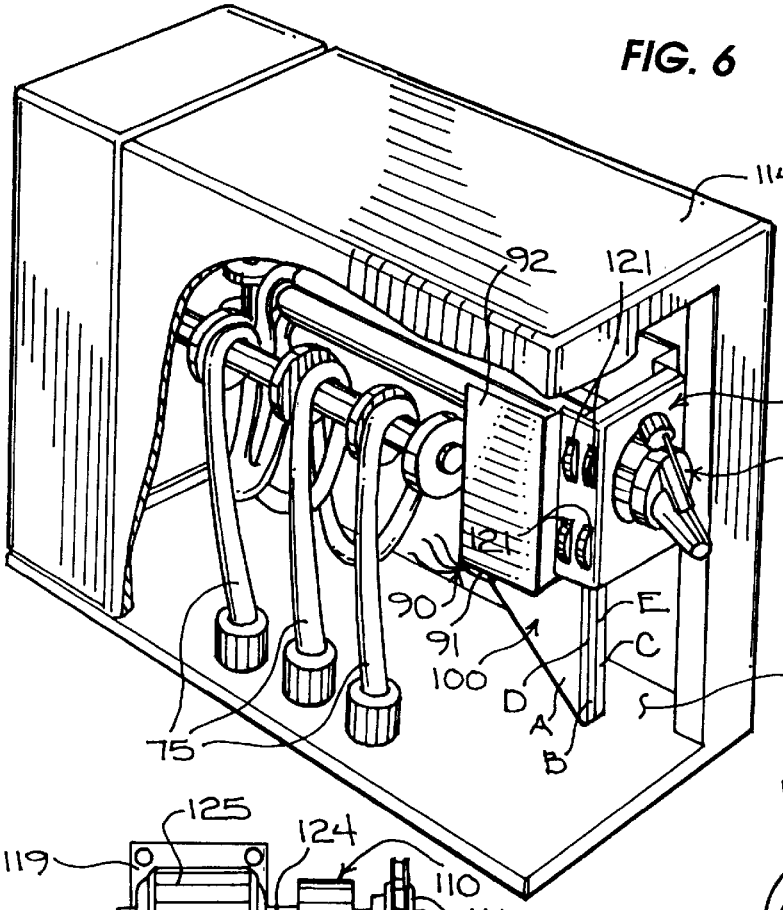
FIG. 6 is an isometric view of the nozzle of FIG. 1 with portions of the housing broken away for the purposes of illustration.
Figure 7:
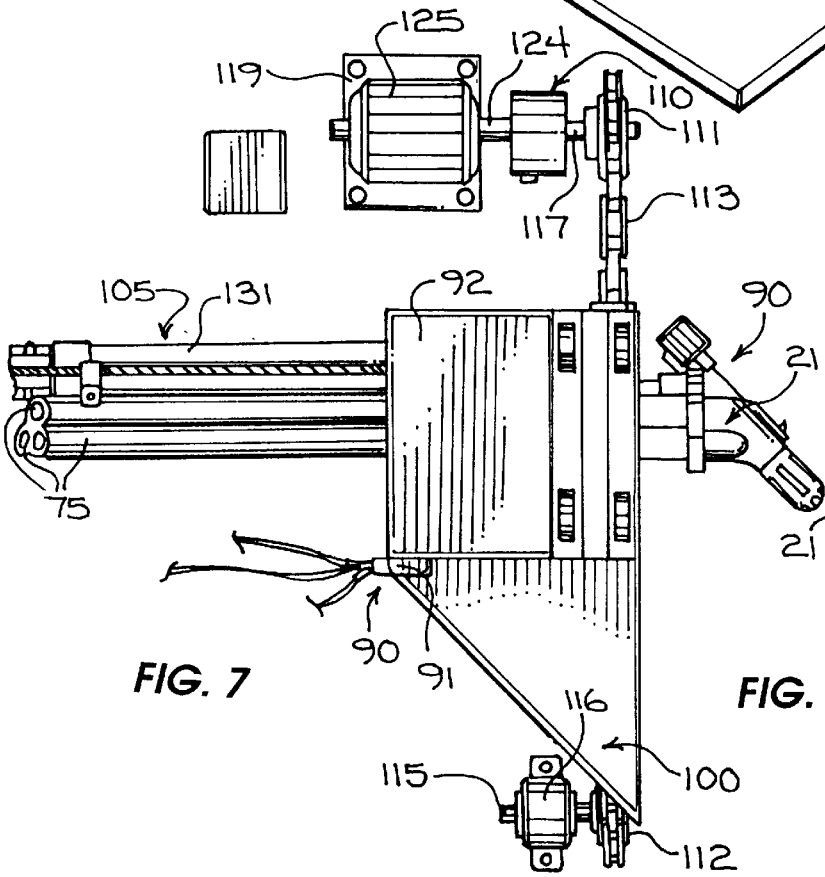
FIG. 7 is a side elevational view of the nozzle of FIG. 6 including drive apparatus for moving the nozzle in reciprocal directions along its Y' and Z' axes.

Nozzle 21 is normally located at a fueling station for providing customer access to one or more types of liquid fuel such as diesel fuel and various grades of unleaded gasoline. In this regard, FIGS. 6 and 7 show a plurality of conduits or hoses 75 each for communicating a specific type of fuel to nozzle 21. In FIG. 1, receiver 23 is shown as it would appear positioned schematically in relation to fragmented portions of vehicle 51 and with system 20. Receiver 23 defines X, Y and Z axes, and nozzle 21 defines X', Y' and Z' axes. System 20 includes interactive alignment structure for aligning the Z and Z' axes and mating nozzle 21 with receiver 23 for fuel delivery, all in response to movement of receiver 23 along its X-axis (depicted spaced from and substantially parallel to X'-axis in FIG. 1), and nozzle 21 along its Y' and Z' axes. Movement of receiver 23 along its X-axis is accomplished, of course, by moving vehicle 51. Movement of nozzle 21 along its Y' and Z' axis is accomplished by actuating first and second drive assemblies 110 and 130, details of which are set forth later in this disclosure.

Interactive alignment structure 80 is supported by nozzle 21 and receiver 23 as shown in FIGS. 6, 7 and 11. Regarding FIG. 11, interactive alignment structure 80 first includes an emitter 82. In this specific example, emitter 82 is carried or supported by receiver body 40, although it could be supported by the vehicle adjacent receiver 23 if desired. Emitter 82 generates and emits a stimulus and, more particularly, a focused stimulus. In a preferred embodiment, emitter 82 includes a power source 83 coupled in electrical communication via electrical interconnection 84 with a focused light or a laser light source 85 that emits a focused laser light beam when energized by power source 83. Power source 83 may comprise a battery, the vehicle's engine battery, etc.

Turning to FIGS. 6 and 7, interactive alignment structure 80 next includes sensor apparatus 90. Sensor apparatus 90 comprises a first sensor 91 supported by a carriage 92 that contains nozzle 21, and a second sensor 93 carried or supported by nozzle body 30 shown in FIG. 11. First and second sensors 91 and 93 are normally energized by a remote or localized power source (not shown) receive or sense the focused stimulus from emitter 82 and, more particularly, the laser light stimulus. In this regard, the first and second sensors 91 and 93 each preferably comprise a light sensor.

Propagating apparatus 100 is associated with first sensor 91, depends from carriage 92 and propagates the laser light stimulus to first sensor 91. Turning to FIG. 6, propagating apparatus 100 comprises a structure 101 of alternating layers light propagating elements and metallic or light reflective elements. In this example, structure 101 includes three light propagating elements A, B and C, and two metallic or light reflective elements D and E. Light propagating elements A, B and C may each comprise thin sheets of glass or other material through which light may pass, and the light reflective elements D and E may each comprise thin sheets of aluminum or other light reflective material. More or less light propagating and reflective elements may be provided if desired depending upon specific needs consistent with the ensuing discussion. Light reflective element D is sandwiched between light propagating elements A and B, and light reflective element E is sandwiched between light propagating elements B and C. Because light propagating elements A, B and C are separated by light reflective elements D and E, each one of the light propagating elements A, B and C defines a discrete light propagating region.

Figure 8:
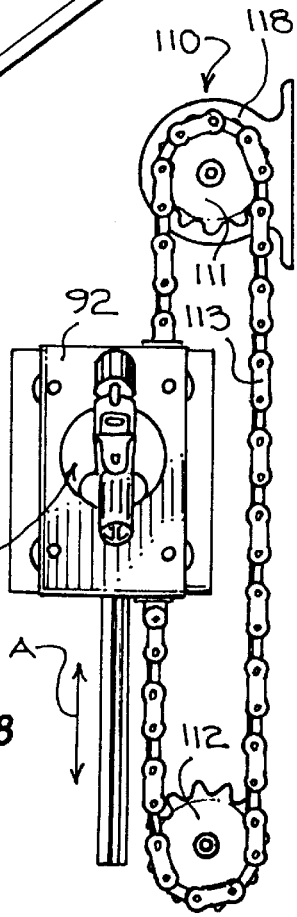
FIG. 8 is front elevational view of a first drive assembly of the drive apparatus of FIG. 7.

As previously mentioned, nozzle 21 is movable reciprocally along its Y' and Z' axes. Although nozzle 21 may be moved manually, the invention includes a drive apparatus 105. Drive apparatus 105 includes a first drive assembly 110 for moving nozzle 21 in reciprocal directions along its Y' axis, and a second drive assembly 130 for moving nozzle 21 in reciprocal directions along its Z' axis. Regarding FIG. 8, first drive assembly 110 includes a drive pinion 111, a spaced-apart driven pinion 112 and a continuous belt or chain 113 supported in meshing engagement with the drive and driven pinions 111 and 112. In this embodiment, chain 113 including a plurality of movably interconnected linkage elements. Carriage 92 is fixed to chain 113 between the drive and driven pinions 111 and 112, and the drive and driven pinions 111 and 112 are supported for rotation with a housing 114 that contains drive assembly 110, carriage 92 and nozzle 21 as shown in FIG. 6. Regarding FIG. 6, driven pinion 112 is journaled for rotation to a shaft 115 fixed to a bracket 116 fastened to housing 114 with screws or rivets. Drive pinion 111 is fixed to a driven shaft 117 leading to a clutch 118. A drive shaft 124 connects clutch 118 with a motor 125 supported by a bracket 119 fastened to housing 116 also with screws or rivets. Motor 125 is a conventional electric motor that is coupled to, and energized by, an external or localized power source (not shown). Motor 118 may be energized in to rotate drive shaft 124 selectively in forward and rearward rotational directions. Clutch 118 transfers the rotational movement of the drive shaft 124 to the driven shaft 117 which, in turn, rotates or drives drive pinion 111 selectively in forward and rearward rotational directions. Rotation of drive pinion 111 causes chain 113 to track about the drive and driven pinions 111 and 112. As chain 113 tracks, it moves carriage 92 and, hence, nozzle 21 along its Y' axis (shown only in FIG. 1) reciprocally between the drive and driven pinions 111 and 112 as denoted by the double arrowed line A in FIG. 8 in response to the forward and rearward rotational movement of drive pinion 111.

Regarding FIG. 6, carriage 92 supports nozzle 21 outwardly in a direction toward, for instance, a customer vehicle. Carriage 92 moves reciprocally in an opening 120 formed through housing 114 (also shown in FIG. 1). Bearings or wheels 121 mounted with carriage 92 run along edges of opening 120 for providing smooth movement.

Second drive assembly 130 includes a pneumatic cylinder assembly 131 as shown in FIG. 7. Although cylinder assembly 131 is not shown in great detail, it is conventional. Cylinder assembly 131 includes an operating rod mounted partially within cylinder for reciprocal movement. The operating rod includes a free end fixed to carriage 92. Like conventional pneumatic cylinder assemblies, movement of the operating rod in reciprocal directions is accomplished by introducing and removing gas to and from the cylinder. Although this is not shown, a motor coupled with a gas source may be employed to carry out this operation. It should be understood tht other devices such as hydraulic cylinders my be used. Accordingly, through selective actuation of cylinder assembly 131, movement of carriage 92 and, hence, nozzle 21 in reciprocal directions along its Z' axis as denoted by the double arrowed line B between retracted and extended positions may be carried out.

Having described nozzle 21, receiver 23, alignment structure 80 and the first and second drive assemblies 110, 113, the typical operation of system 20 will now be discussed. The computer system 22 is interfaced with interactive alignment structure 80. When interactive alignment structure 80 interacts, the computer system 50 and interactive alignment structure 80 signal interface. In response to this signal interface, the computer system 50 displays messages on a monitor 81 instructing the customer to move vehicle 51 forward or backward along the X axis to align the Y and Y' axes and the Z and Z' axes in a common two-dimensional plane. Upon achievement of the alignment of the Y and Y' axes and the Z and Z' axes in a common two-dimensional plane, the computer system 22 instructs the customer to stop the vehicle. Once stopped, the computer system 22 actuates the first and second drive assemblies 110 and 13 to align the Z and Z' axes and mate the nozzle 21 with the receiver 23 for fuel delivery. In response to completion of fuel delivery and, the computer system 22 actuates the second drive assembly 130 to move nozzle 21 away from receiver 23.

Figure 9:
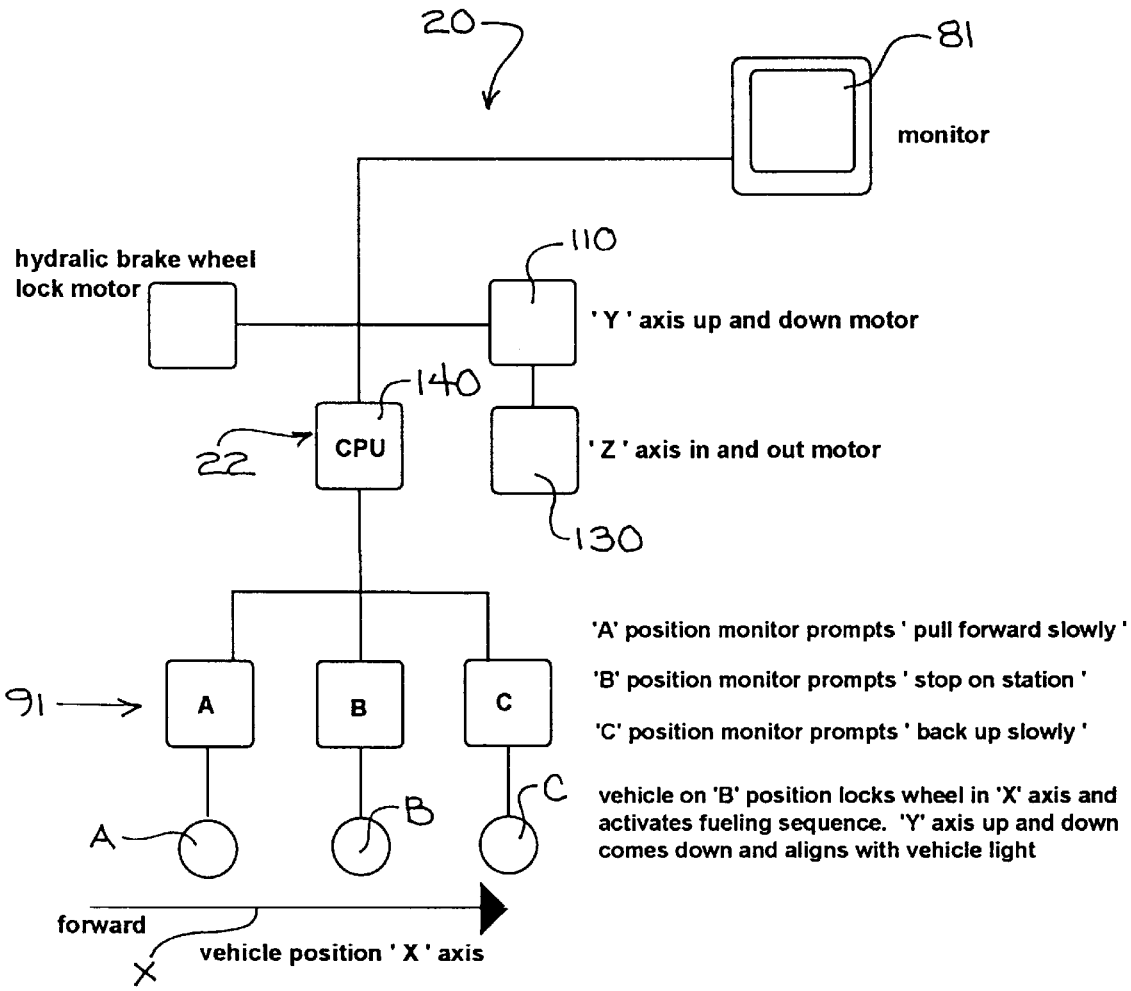
FIG. 9 is a schematic representation of the system of FIG. 1.

For a more complete discussion of the foregoing process, attention is directed to FIG. 9 which illustrates a schematic representation of system 20. In the fueling process, the first and second sensors 91 and 93 are each normally energized. Emitter 82 may be either constantly energized for constantly emitting laser light stimulus, or selectively actuated by the customer with an ON/OFF switch located inside the vehicle. As a customer moves her vehicle and, hence, receiver 23 along axis X, the laser light stimulus encounters structure 101 in a direction from light propagating element A to light propagating element C. When the laser light stimulus encounters light propagating element A, it propagates the light to first sensor 91. In response, first sensor 91 sends a signal A to a central processing unit (CPU) 140 if computer system 22. In response to signal A, CPU 140 generates a message "pull forward slowly" to the customer. This first message may be an audible and/or a visual message displayed on monitor 81. Looking to FIG. 5, monitor 81 positioned in such a way that it is easily viewable by a customer when maneuvering vehicle 51 along axis X. As the customer pulls forward in response to this first message, the laser light stimulus encounters light propagating element B which propagates the light to first sensor 91. In response, first sensor 91 sends a signal B to CPU 140. In response to signal B, CPU 140 generates a second message "stop on station" to the customer. This second message may be an audible message or a visual message displayed on monitor 81. Should the customer fail to stop as instructed, the laser light stimulus encounters light propagating element C which propagates the light to first sensor 91. In response, first sensor 91 sends a signal C to CPU 140. In response to signal C, CPU 140 generates a third message "back up slowly" to the customer. This third message may be an audible message or a visual message displayed on monitor 81. As the customer pulls vehicle back along axis X, the laser light stimulus again encounters light propagating element B which propagates the light to first sensor 91. In response, first sensor 91 again sends a signal B to CPU 140 and CPU 140 will generate the second message "stop on station" to the customer. When the customer stops as instructed with the laser light stimulus encountering light propagating element B, alignment of the Y and Y' axes and the Z and Z' axes in a common two-dimensional plane is achieved.

At this point, CPU 140 actuates motor 125 of first drive assembly 110 to move nozzle 21 along its Y' axis in reciprocal between the drive and driven pinions 111 and 112 until the laser light stimulus encounters the second sensor 93. In response to encountering the laser light stimulus, the second sensor sends a first signal to CPU 140. In response to this first signal, CPU 140 deactivates motor 125. At this point, the Z and Z' axes align. In response to this first signal, CPU 140 also actuates second drive assembly 30 to move nozzle 21 along its Z' axis toward the receiver 23. With the Z and Z' axis aligned, receiver 23 will receive nozzle 21 in response to movement of nozzle 21 toward receiver 23 along its Z' axis. Looking momentarily to FIG. 11, the open distal end 32 of nozzle body 30 is angled downward. When nozzle body 30 encounters receiver 23, clutch 118 allows nozzle body 30 migrate and seat into receiver 23. Upon seating into receiver 23, plug 45 moves into its open position and switch 34 actuates to begin fuel flow from nozzle 21 into the fuel tank as previously discussed. When switch 34 actuates to stop the fuel flow through nozzle 21 as previously discussed, it sends a signal to CPU 140 and, in response to this signal, actuates second drive assembly 130 to move nozzle 21 out of, and away from, receiver 23. This completes the fueling operation.

Figure 5:
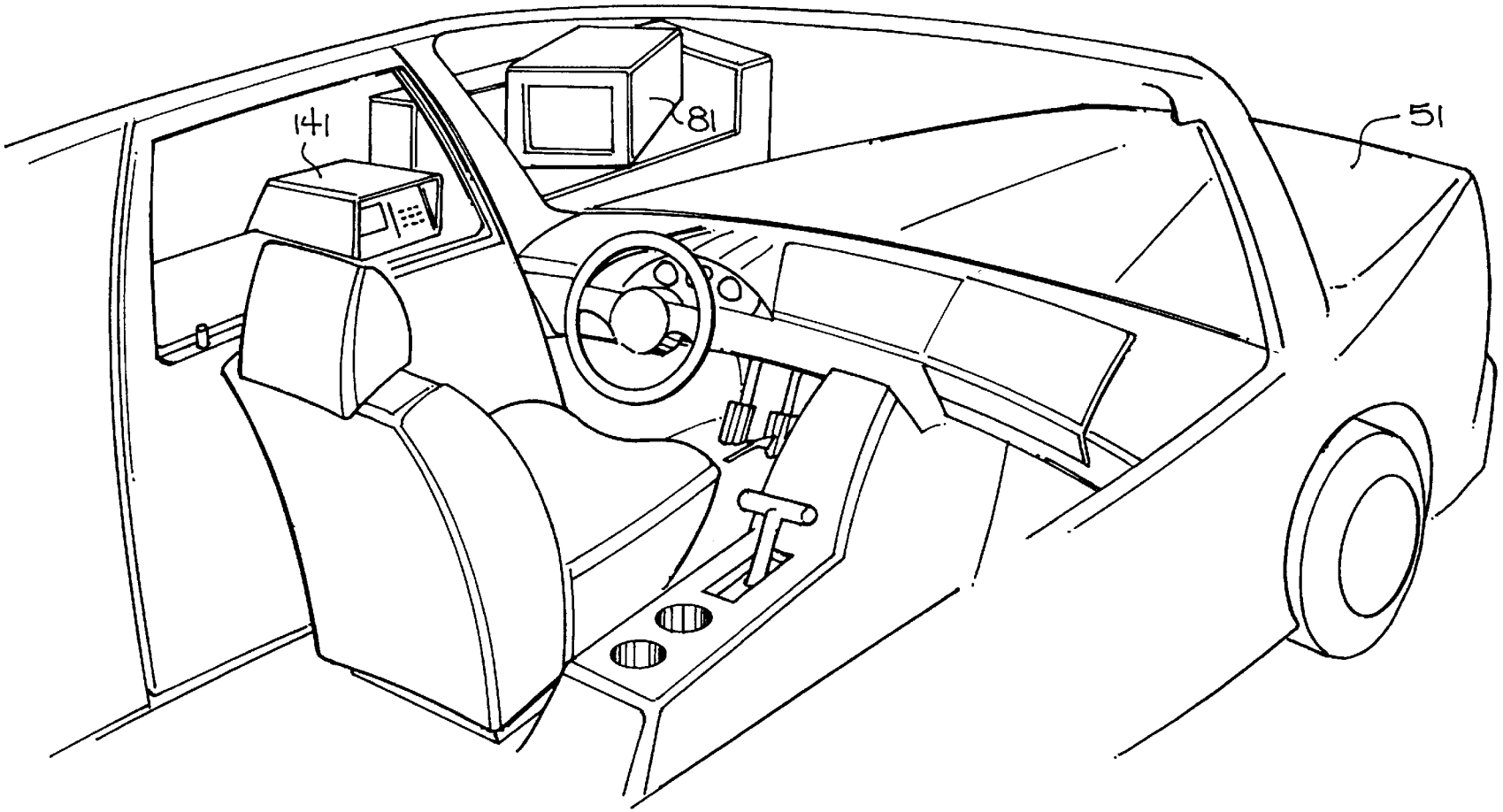
FIG. 5 is a fragmented isometric view of the vehicle shown as it would appear next to the system of FIG. 1.

Regarding FIGS. 1 and 5, the system 20 preferably includes a terminal 141 interfaced with CPU 140. Customers may use this terminal 141 to pay for fuel and to select the type of fuel desired for purchase. Terminal 141 may, therefore, be equipped for accepting credit and debit card payments and may include a keypad for facilitating customer interface. Furthermore, although the fueling operation may be stopped with switch 34 when the gas tank becomes full, a customer may enter an amount of fuel for purchase either in the form of a desired fuel amount or a desired monetary amount. The CPU 140 saves this information and, when this amount is reached during the fueling process, actuates switch 34 to stop the fuel flow through nozzle 21.

Figure 3:
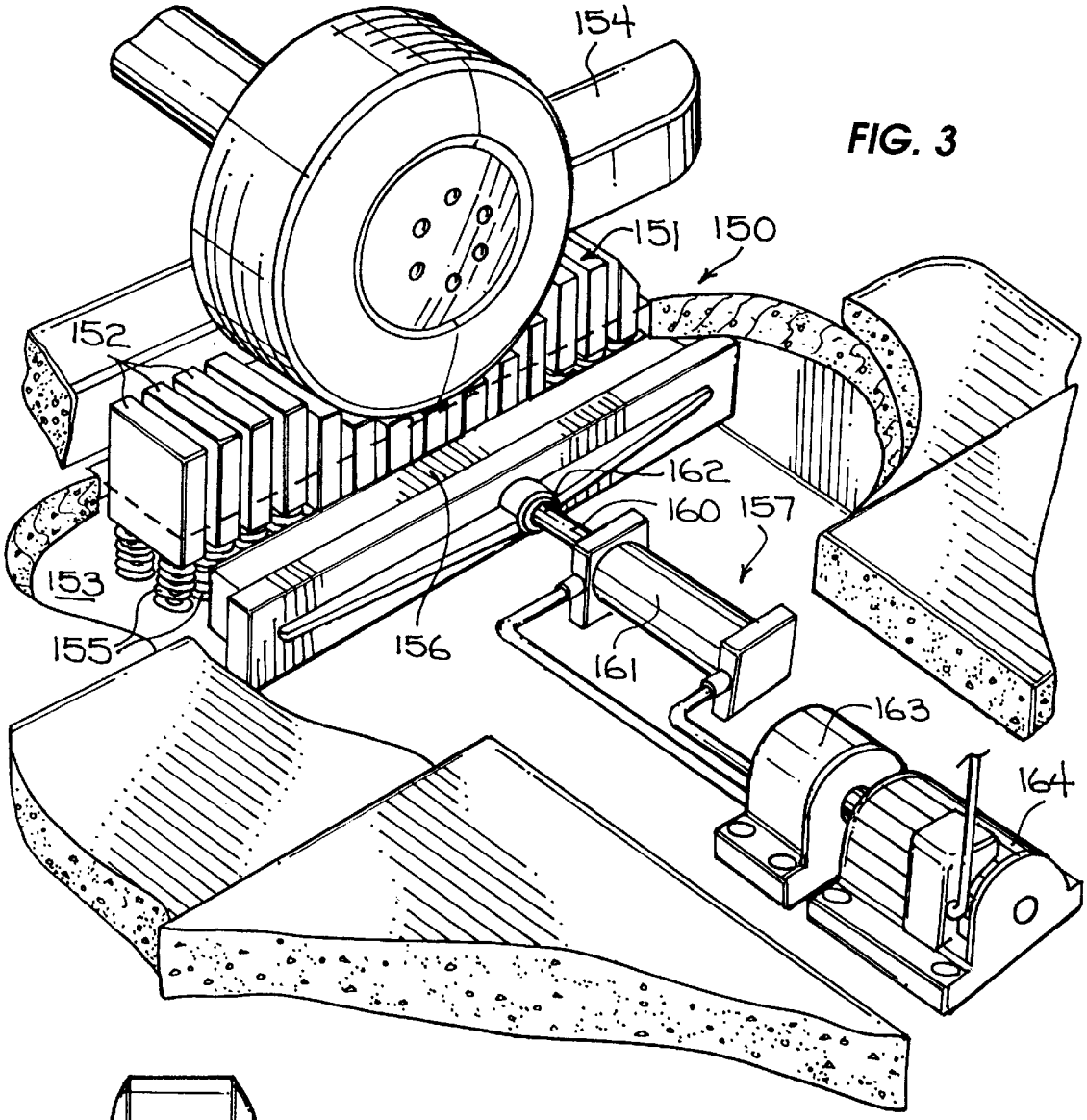
FIG. 3 is an enlarged isometric view of a brake assembly of FIG. 1.
Figure 4:
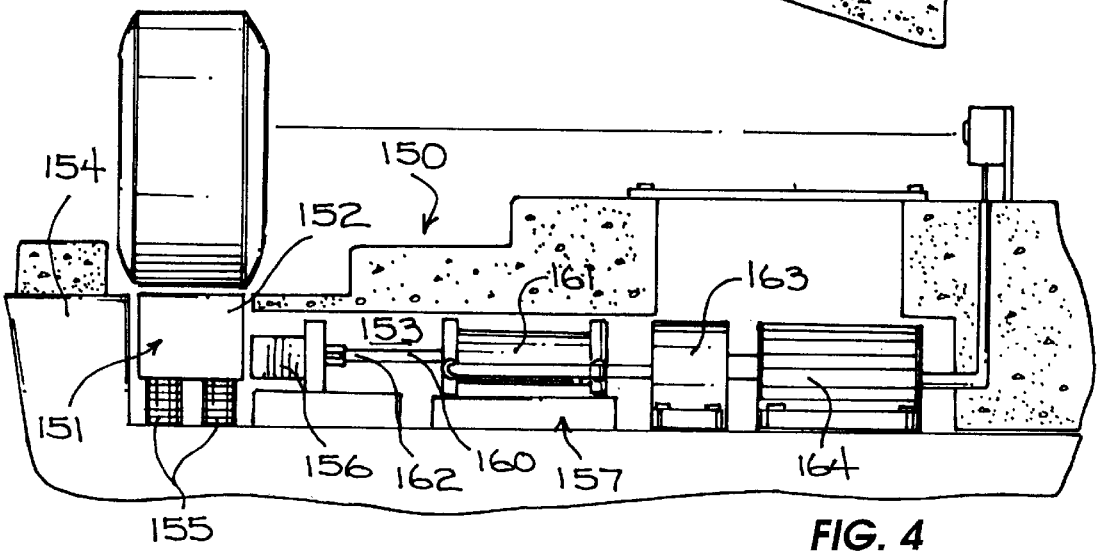
FIG. 4 is a side elevational view of the brake assembly of FIG. 3.

To increase the ease and efficiency of system 20, it may further include a brake assembly 150 engagable with one of the wheels of vehicle 51 for holding it stationary during fueling. Turning to FIG. 3, brake assembly 150 includes a pad 151 having a normal flexible character for receiving one of the wheels of the vehicle and a substantially rigid character for capturing one of the wheels of the vehicle. The pad 151 comprises a plurality of upstanding elements or extensions 152 arranged in series on the ground for one of the wheels of a vehicle to run over. The pad 151 is positioned in a recess or cavity 153 formed into the ground adjacent a curb 154, and supports one of the wheels of vehicle 51 when the Y and Y' axes and the Z and Z' axes align in a common two-dimensional plane. A flexible base 155 carries each extension 152. In this example, each flexible base 155 includes a plurality of high-strength compression springs. An elongate clamp 156 is mounted in recess 153 alongside pad 151 for movement in reciprocal directions relative pad 151. In this specific embodiment, a cylinder assembly 157 moves the elongate clamp 156 in reciprocal directions. The cylinder assembly 157 includes an operating rod 160 mounted partially in a cylinder 161 for reciprocal movement. Operating rod 160 terminates with a free end 162 fixed to elongate clamp 156. Cylinder 161 is coupled in fluid communication with a source 163 of hydraulic liquid. A conventional motorized pump 164 coupled to the source 163 and with CPU 140 (shown only in FIG. 9) moves hydraulic fluid into and from cylinder 161 in response to actuation for moving operating rod 160 in reciprocal directions for in turn moving elongate clamp between a first position spaced from pad 151 and a second position against pad 151 substantially rigidly securing them against curb 154.

Extensions 152 of pad 151 are free to give and flex in the first position of elongate clamp 156 which permits the wheels of a vehicle to roll over them. As the wheels run over pad 151, its flexibility allows it to conform somewhat to the footprint of each wheel. Yet, when the Y and Y' axes and the Z and Z' axes align in a common two-dimensional plane, CPU 140 actuates pump 164 to move elongate clamp 156 against pad 151 substantially rigidly securing it against curb 154. When clamped against curb 154, pad 151 is substantially rigid and holds the wheel located on the pad 151 at a fixed position along axis X which prevents the vehicle from migrating along axis X during the fueling process. After completion of the fueling process as discussed above and the CPU 140 has moved nozzle 21 away from receiver 23, CPU 140 actuates pump 164 to move elongate clamp 156 away from pad 151 which allows the extensions 152 to assume their normal flexible character to permit the customer to drive her vehicle away.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is.

What is claimed is:

1. A system for delivering fuel to a fuel tank of a wheeled vehicle, the system comprising:

a receiver coupled in liquid communication with a fuel tank of the vehicle, the receiver defining X, Y and Z axes;

a nozzle coupled in liquid communication with a fuel source, the nozzle defining X', Y' and Z' axes;

interactive alignment structure for aligning the Z and Z' axes and mating the nozzle with the receiver for fuel delivery in response to movement of the receiver along the X-axis and the nozzle along the Y' and Z' axes; and a brake assembly comprising a pad having a normal flexible character for receiving one of the wheels of the vehicle and a substantially rigid character for capturing one of the wheels of the vehicle for holding the vehicle at a fixed position along the X-axis.

2. The system of claim 1, wherein the interactive alignment structure is carried by the receiver and the nozzle.

3. The system of claim 2, wherein the alignment structure comprises:

an emitter carried by one of the receiver and the nozzle for emitting a stimulus; and sensor apparatus carried adjacent the other one of the receiver and the nozzle for receiving the stimulus.

4. The system of claim 3, wherein the sensor apparatus includes a first sensor for receiving the stimulus for aligning the Y and Y' axes and the Z and Z' axes in a two-dimensional plane in response to movement of the receiver along the X-axis.

5. The system of claim 4, wherein the sensor apparatus further includes a second sensor for receiving the stimulus for aligning the Z and Z' axes and mating the nozzle with the receiver in response to movement of the nozzle along the Y' and Z' axes.

6. The system of claim 5, wherein the stimulus comprises laser light.

7. The system of claim 6, wherein the first sensor comprises a light sensor.

8. The system of claim 6, wherein the second sensor comprises a light sensor.

9. The system of claim 1, further include drive apparatus for moving the nozzle in reciprocal directions along the Y' and Z' axes.

* * * * *